US006980078B2

(12) United States Patent
Rouser

(10) Patent No.: US 6,980,078 B2
(45) Date of Patent: Dec. 27, 2005

(54) MAGNETIC CORE DEVICE AND ASSEMBLY METHOD

(75) Inventor: Richard F. Rouser, Logansport, IN (US)

(73) Assignee: Delphi Technologies, Inc., Troy, MI (US)

( * ) Notice: Subject to any disclaimer, the term of this patent is extended or adjusted under 35 U.S.C. 154(b) by 96 days.

(21) Appl. No.: 10/446,061

(22) Filed: May 27, 2003

(65) Prior Publication Data

US 2004/0239466 A1 Dec. 2, 2004

(51) Int. Cl.[7] ..... H01F 27/24
(52) U.S. Cl. ..... 336/216
(58) Field of Search ..... 336/210–219, 336/233, 234

(56) References Cited

U.S. PATENT DOCUMENTS 4,864,486 A * 9/1989 Spreen ..... 363/126
5,719,483 A 2/1998 Abbott et al.
6,392,519 B1 5/2002 Ronning
6,456,069 B1 * 9/2002 Scarzello et al. ..... 324/253

FOREIGN PATENT DOCUMENTS

JP 05121239 5/1993
JP 2000124032 4/2000

OTHER PUBLICATIONS

Khai D. T. Ngo and M. H. Kuo, "Effects of Air Gaps on Winding Loss in High-Frequency Planar Magnetics," Apr. 1988, pp. 1112-1119.
Dave LeVasseuer, "Midcom Transformer Theory," Jun. 1, 1998, pp. 1-70.
European Search Report dated Feb. 22, 2005.

* cited by examiner

*Primary Examiner*—Ramon M. Barrera
(74) *Attorney, Agent, or Firm*—Stefan V. Chmielewski

(57) ABSTRACT

A magnetic core device is provided having first and second magnetic core members. The first core member is generally E-shaped having first, second, and third surfaces. The first, second, and third surfaces have first, second, and third surface areas, respectively. The second magnetic core member is generally planar for joining with the first, second, and third surfaces of the first magnetic core member. The second core member is oversized relative to the first core member to allow for shifted and/or skewed alignment of the core members.

31 Claims, 2 Drawing Sheets

MAGNETIC CORE DEVICE AND ASSEMBLY METHOD

TECHNICAL FIELD

The present invention generally relates to magnetic devices, and more particularly relates to the assembly of magnetic cores for forming a magnetic device.

BACKGROUND OF THE INVENTION

Some electronic devices such as inductors and transformers employ magnetic cores that generate an induced magnetic flux. Many conventional magnetic cores are assembled together as two separate magnetic core members that form a magnetic flux circuit. One approach employs a pair of generally E-shaped magnetic core members that are assembled such that the open ends of each arm join with each other to provide the induced magnetic flux path. Each arm has a connecting surface designed to align with like size and shape surface areas on the opposing magnetic core member. Another approach employs the assembly of a generally E-shaped magnetic core member assembled to a planar-shaped plate core member.

In the above-described conventional core assemblies, the two magnetic core members both have the same general overall width and length. As a consequence, the two magnetic core members must be properly aligned to minimize magnetic flux losses. The alignment procedure is difficult to implement in some applications, such as in the assembly of core members for use as a transformer or inductor that is integrated into a printed circuit board. The installation of an upper core member onto a lower core member through the circuit board may occur in a blind operation, thus inhibiting assurance of precise alignment of the two core members.

Misalignment of the two magnetic core members reduces the effective cross-sectional area of the conventional core device. The magnetic flux passing from one core member to the other misaligned core member is forced to crowd to the remaining contact surface to complete the magnetic flux path, which is known as flux crowding. Increased flux density or crowding may lead to core saturation near the adjoining surfaces which may produce unwanted thermal energy (heat). Additionally, not all of the densified magnetic flux will make it through the reduced size of the adjoining surfaces, thereby causing some magnetic flux to pass outside of the core, which is known as flux fringing. With flux fringing, magnetic flux passes into the surrounding environment and possibly into the nearby circuitry where eddy currents are generated, energy is wasted, and noise may be introduced.

Flux fringing and flux crowding may occur in conventional magnetic core assemblies where the two magnetic core members are shifted relative to each other and/or are rotated in a skewed alignment. In either situation, a reduction in the cross-sectional area of the magnetic flux circuit is realized which reduces overall inductance. Additionally, a reduction in the cross-sectional area increases the flux density or crowding in the device and also results in flux fringing. The resultant reduction in cross-sectional area of the magnetic flux circuit due to shifted and/or skewed alignment of the two core members therefore results in reduced performance.

Accordingly, it is therefore desirable to provide for a magnetic core device made up of the assembly of two magnetic core members that does not suffer from a reduced magnetic flux path area due to the alignment procedure. It is further desirable to provide for a magnetic core device having two core members that may be, easily aligned to minimize flux fringing and flux crowding so as to optimize performance of the magnetic core device. It is particularly desirable to provide for such a magnetic core device that may be assembled onto a circuit board, such as a printed circuit board, where shifting and/or skewed alignment of the core members may occur.

SUMMARY OF THE INVENTION

According to the present invention, a magnetic core device is provided having first and second magnetic core members. The first core member has a generally open shape and first and second surfaces. The first and second surfaces have first and second surface areas, respectively. The second magnetic core member has third and fourth surfaces for joining with the first and second surfaces, respectively, of the first magnetic core member. The third and fourth surfaces have oversized third and fourth surface areas such that the third surface area is greater than the first surface area, and the fourth surface area is greater than the second surface area.

According to one aspect of the present invention, the magnetic core device includes a generally E-shaped magnetic core member and a generally planar magnetic core member. The generally E-shaped magnetic core member has first, second, and third end surfaces for providing magnetic flux. The first magnetic core member has a length and a width. The first, second, and third end surfaces of the E-shaped core member are assembled to join the generally planar magnetic core member to form a magnetic flux circuit. The generally planar magnetic core member has a length and a width that is greater than at least one of the length and width of the generally E-shaped core member.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
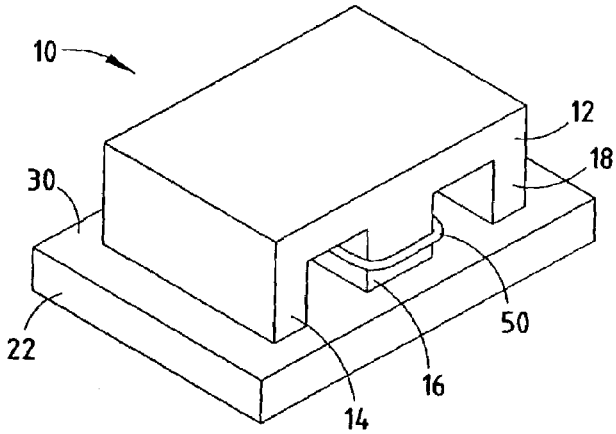
FIG. 1 is a perspective view of a magnetic core device made up of the assembly of first and second core members according to the present invention.

Referring to FIG. 1, a magnetic core device 10 is illustrated made up of the assembly of a first core member 12, shown as the upper member, and a second core member 22, shown as the lower core member. The first and second core members 12 and 22 are made of magnetic material such as a ferromagnetic material for generating magnetic flux. In doing so, the first and second magnetic core members 12 and 22 are positioned in relation to each other to form substantially closed magnetic flux circuits as described herein. The magnetic core device 10 may be used in any of a number of applications including use in an inductor, a transformer, or other components that require magnetic flux.

The second magnetic core member 22 is shown as a substantially planar-shaped plate having an upper surface 30 engaging or in close proximity to end surface areas of the first magnetic core member 12 to form magnetic flux paths. The first magnetic core member 12 is shown configured as an E-shaped member having first, second, and third arms 14, 16, and 18. The first and third arms 14 and 18 are formed at opposite ends of core member 12. The second arm 16 is formed midway between the first and second arms 14 and 18. The second arm 16 has a width of about twice the width of either of arms 14 and 18.

Also shown wound in a loop around the second middle arm 16 is an electrically conductive coil 50. Coil 50 extends through passageways 20 intermediate the end arms 14 and 18 and middle arm 16. The electrically conductive coil 50 may include a single turn coil, according to one embodiment. According to another embodiment, the electrically conductive coil 50 may be wound in a plurality of turns. The electrically conductive coil 50 allows current flow in a direction substantially perpendicular to the magnetic flux passing through the middle arm 16.

Figure 2:
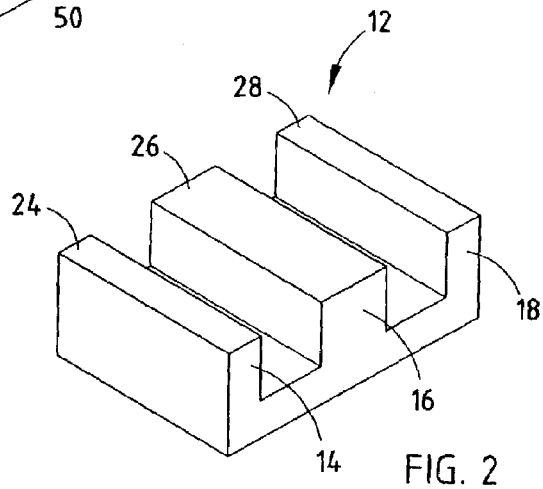
FIG. 2 is a bottom perspective view of the upper core member.

The upper magnetic core member 12 is further shown in FIG. 2 having end surface areas 24, 26, and 28 for joining upper surface 30 of second core member 22 to complete the magnetic flux paths. The first end surface 24 is provided at the end of arm 14 and provides a surface area defined by its width and length. The second end surface 26 is formed at the end of second arm 16 and provides a surface area defined by its length and width. The third surface area 28 likewise is formed at the end of third arm 18 and is also defined by its length and width. The length extending from and including the first to the third surface areas 24 and 28 and the width of the surface areas 24, 26, and 28 defines the outer perimeter of the first magnetic core member 12.

Figure 3:
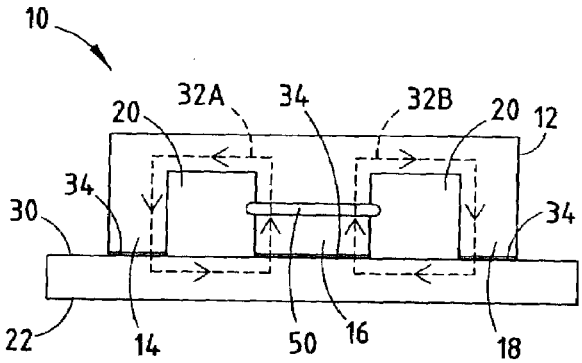
FIG. 3 is a front side view of the magnetic core device shown in FIG. 1.

The magnetic core device 10 is further illustrated from a front view in FIG. 3 with the upper core member 12 substantially centered on lower core member 22. The upper core member 12 is shown adhered to the upper surface 30 of lower core member 22 via an adhesive 34. The adhesive 34 is disposed between end surfaces 24, 26, and 28 of upper core member 12 and upper surface 30 of lower core member 22. The adhesive 34 may include any of a number of known adhesives. The thickness of adhesive 34 will determine the separation distance, if any, between the adjoining upper and lower core members 12 and 22. However, it should be appreciated that the upper and lower core members 12 and 22 may be in direct contact with each other. In lieu of the adhesive 34, any of a number of other techniques may be employed to retain the positioning of the first and second magnetic core members 12 and 22 fixed in place relative to each other. For example, the first and second magnetic core members 12 and 22 may be fastened directly together or may be directly fastened to another supporting member such as a circuit board.

The use of an E-shaped upper core member 12 provides first and second magnetic flux circuits that allow for the generation of first and second magnetic flux paths 32A and 32B which are shown in dashed lines in FIG. 3. The magnetic flux paths 32A and 32B indicate magnetic flux circulates through end arms 14 and 18, and magnetic flux paths 32A and 32B are joined together in the same direction through the middle arm 16. The magnetic flux through middle arm 16 travels substantially perpendicular to current flow in the electrically conductive coil 50.

Figure 4:
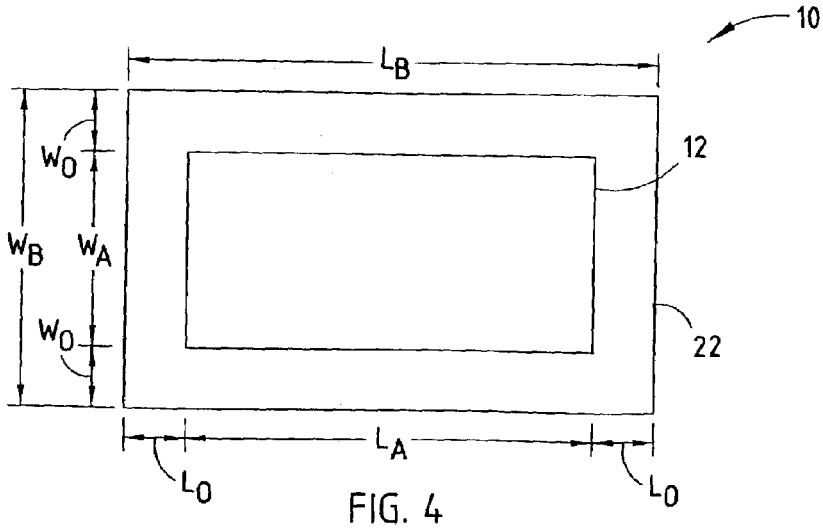
FIG. 4 is a top view of the magnetic core device shown in FIG. 1.

The magnetic core device 10 according to the present invention is provided with an over-sized lower core member 22 as compared to the size of the upper core member 12. Referring to FIG. 4, the upper core member 12 has an overall length $L_A$ and an overall width $W_A$ which generally defines the perimeter of the upper core member 12 including the perimeter of the magnetic flux path. In contrast, the lower core member 22 has an overall length $L_B$ and an overall width $W_B$, both of which are greater than the length $L_A$ and width $W_B$ of the upper core member 12. According to the arrangement shown, the lower core member has a length $L_B$ greater than length $L_A$ by an amount equal to $2L_O$. Similarly, the lower core member 22 has a width $W_B$ greater than width $W_A$ by an amount equal to $2W_O$. Accordingly, the lower core member 22 has an oversize length $L_B$ and width $W_B$ greater than the length $L_A$ and width $W_A$ of the upper core member 12 by offset amounts equal to $2L_O$ and $2W_O$, respectively.

The oversized dimensions of the lower core member 22 relative to the upper core member 12 are sufficiently large enough to allow for shifted and/or skewed alignment of the two core members 12 and 22 relative to each other. The amount of oversize of lower core member 22 relative to upper core member 12 is preferably greater than a minimal amount of the maximum offset placement error tolerance of upper core member 12 plus the maximum dimensional tolerance allowed for the manufacture of the upper core member 12.

By providing an oversized lower core member plate 22, the first and second core members 12 and 22 may be assembled together with a shifted alignment and/or a skewed alignment while substantially reducing or eliminating changes in inductance and reducing flux crowding and flux fringing. That is, the end surface areas 24, 26, and 28 of upper core member 12 remain in contact or near contact with upper surface 30 of lower core member 22, despite shifted and/or skewed alignment of the two core members 12 and 22, within a limited degree of relative movement. Despite some shifting and/or skew alignment, the oversized lower plate 22 allows the magnetic flux to circulate from one core member into the other core member and return back with little or no losses generally associated with reduced cross-sectional area at the adjoining surfaces.

Figure 5:
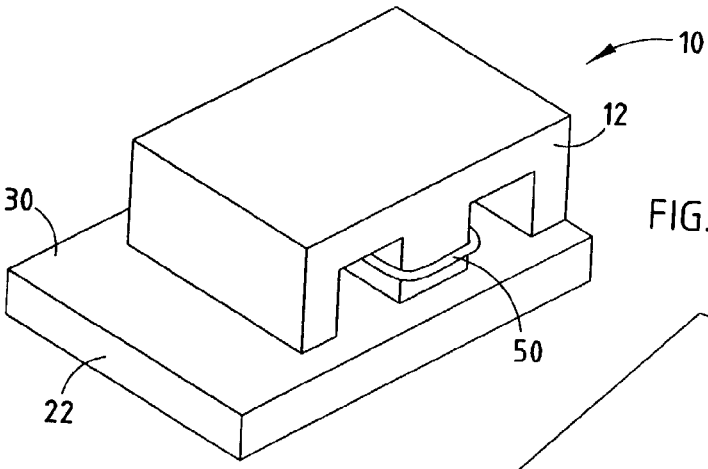
FIG. 5 is a perspective view of the magnetic core device shown assembled in a shifted alignment.
Figure 6:
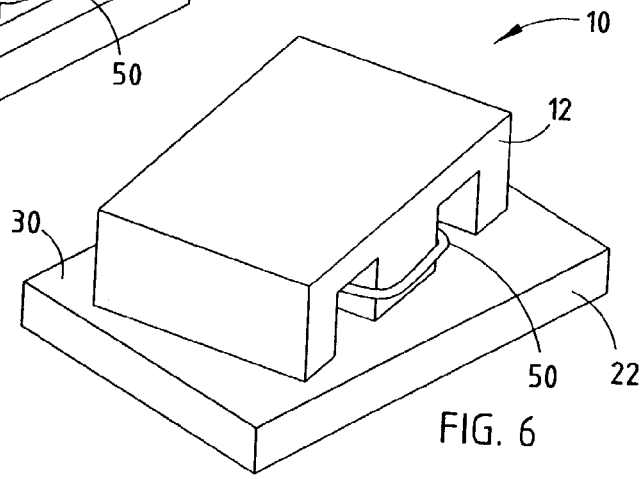
FIG. 6 is a perspective view of the magnetic core device shown assembled in a skewed alignment.

To further illustrate the advantages of the present invention, the magnetic core device 10 is illustrated in FIG. 5 with the upper core member 12 shifted along its length relative to the lower core member 22. The two core members 12 and 22 are able to shift relative to each other while still providing contact or near contact between the two core members 12 and 22 to complete the magnetic flux circuit. Referring to FIG. 6, the upper core member 12 is shown skewed relative to the lower core member 22. By providing oversized core member plate 22, the upper core member 12 is able to be skewed in its alignment relative to the lower core member 22 to within a limited degree of movement.

Figure 7:
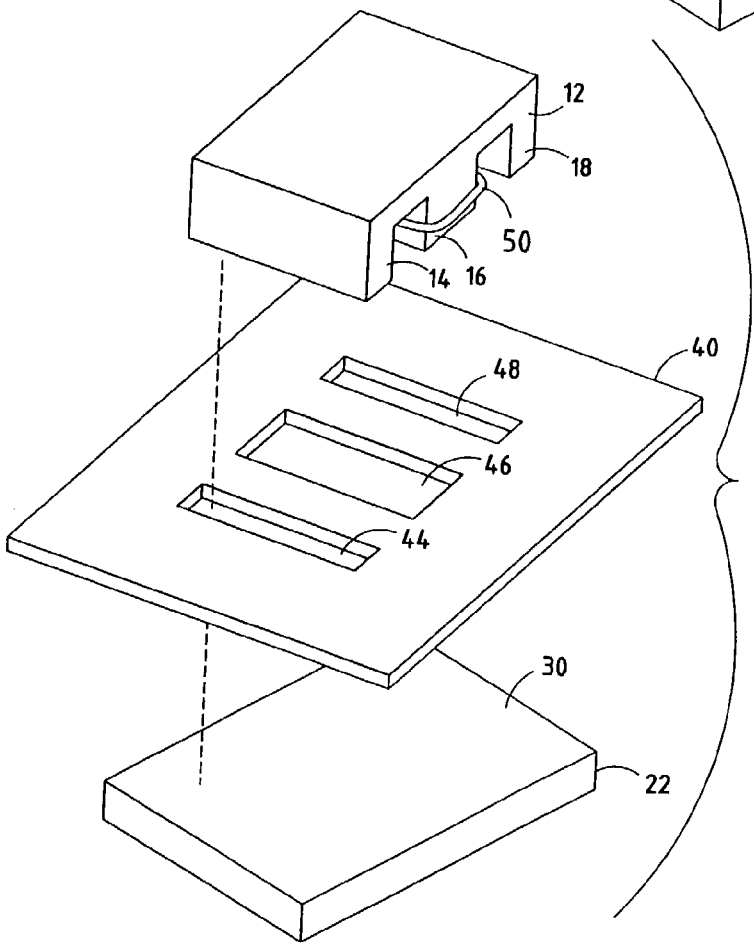
FIG. 7 is an exploded view of the assembly of the magnetic core device onto a printed circuit board.

Referring to FIG. 7, the assembly of the upper core member 12 and lower core member 22 together onto a printed circuit board 40 is illustrated. The printed circuit board 40 includes first, second, and third rectangular cutout openings 44, 46, and 48. Each of the cutout openings 44–48 has a dimension greater than the outer dimensions of arms 14, 16, and 18, respectively. In a typical blind assembly arrangement, the openings 44, 46, and 48 are generally oversized relative to the outer perimeter dimensions of arms 14, 16, and 18, respectively, to enable ease of the blind assembly of the components, which further results in the possible shifted alignment and/or skewed alignment of upper core member 12 relative to lower core member 22. During the assembly, the upper core member 12 is inserted such that arms 14, 16, and 18 extend into cutout openings 44, 46, and 48, respectively, in printed circuit board 40. The lower core member plate 22 is then adhered or otherwise fastened to remain in position relative to the end surfaces 24, 26, and 28 of upper core member 12.

The oversized core member plate 22 should be fabricated with an overall length $L_B$ and width $W_B$ sufficiently large enough to retain the mating end surfaces of upper core member 12 within the area dimensions of its upper surface area 30. However, in order to minimize cost, the oversized core member plate 22 should not be excessively large. Thus, the oversized core member 22 need only be large enough to accommodate the maximum tolerance of possible shifting and/or skew alignment of the upper and lower core members 12 and 22.

While an upper E-shaped core member 12 and lower plate-shaped core member 22 are shown and described herein, it should be appreciated that the magnetic core device 10 may be formed of other two-piece magnetic core assemblies that form a magnetic flux circuit. For example, a single C-shaped or U-shaped core member may be assembled on an oversized plate-shaped core member according to another embodiment. Other examples of open face core members may include various other shaped cores including cores commonly referred to as RM cores, ER cores, PQ cores, and PT cores. According to a further embodiment, a pair of open core members, such as two E-shaped core members, may be assembled together, with one of the two E-shaped core members having enlarged (oversized) end surfaces formed in each of the arms to allow for shifted and/or skewed alignment of the adjoining end surfaces.

By providing an oversized magnetic core relative to another magnetic core, the present invention advantageously provides for a magnetic core device 10 that is allowed to be assembled in a shifted and/or skewed alignment, without suffering from drawbacks experienced in conventional two part core assembly arrangements. It should be noted that while an initial inductance value of the assembled component employing the oversized core member may be slightly higher than with a perfectly aligned same-sized core assembly due to increased volume of the core material, it should be appreciated that once the inductance value is established no substantive further changes occur due to positioning of the two core members 12 and 22.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. A magnetic core device for generating magnetic flux comprising:

a first magnetic core member having a generally open shape and first and second surfaces, said first and second surfaces having first and second surface areas, respectively; and a second magnetic core member having third and fourth surfaces for joining with the first and second surfaces, respectively, of the first magnetic core member to form a magnetic flux path, wherein the third and fourth surfaces have oversized third and fourth surface areas such that the third surface area has a length and a width that is greater than a length and a width of the first surface area and the fourth surface area has a length and a width that is greater than a length and a width of the second surface area, and wherein the oversized third and fourth surface areas are only sufficiently larger to accommodate shifting and skew alignment during assembly of the first and second magnetic core members.

2. The device as defined in claim 1, wherein the first magnetic core member further includes a middle surface formed between the first and second surfaces, and the second magnetic core member comprises a middle surface having an oversized area greater than the area of the middle surface of the first magnetic core member.

3. The device as defined in claim 2, wherein the first magnetic core member comprises a generally E-shaped core member, and the second magnetic core member comprises a generally planar core member.

4. The device as defined in claim 1, wherein the device is employed in an inductor.

5. The device as defined claim 1, wherein the device is employed in a transformer.

6. The device as defined in claim 1, further comprising an electrical conductor wound around a magnetic flux path of the device.

7. The device as defined in claim 1, wherein the first magnetic core member is adhered to the second magnetic core member.

8. A magnetic core device for generating magnetic flux comprising:

a generally E-shaped magnetic core member having first, second, and third surfaces for providing magnetic flux, said E-shaped magnetic core member having a length and width; and a generally planar magnetic core member for joining the first, second, and third surfaces of the E-shaped core member to form a magnetic flux circuit, said generally planar magnetic core member having a length and width, wherein the length and width of the generally planar core member is greater than the corresponding length and width of the generally E-shaped core member such that the generally planar magnetic core member is oversized only sufficiently to accommodate shifting and skew alignment of the generally E-shaped and generally planar magnetic core members.

9. The magnetic device as defined in claim 8, wherein the generally planar magnetic core member is oversized only sufficiently to accommodate shifting and skew alignment during assembly with the E-shaped magnetic core member.

10. The magnetic device as defined in claim 8, wherein the E-shaped magnetic core member has first and second arms formed at opposite ends and a third arm formed substantially midway between the first and second arms, wherein the first, second, and third arms contain the first, second, and third surfaces.

11. The device as defined in claim 8, further comprising an electrical conductor wound around a magnetic flux path of the device.

12. The device as defined in claim 8, wherein the first magnetic core member is adhered to the second magnetic core member.

13. The device as defined in claim 8, wherein the device is mounted on a circuit board.

14. A method of assembling a magnetic core device for generating magnetic flux comprising:

providing a first magnetic core member having a generally open shape and first and second surfaces, wherein the first and second surfaces have first and second surface areas, respectively;

providing a second magnetic core member having third and fourth surfaces, wherein the third and fourth surfaces have oversized third and fourth surface areas such that the third surface area has a length and a width that is greater than the first surface area and the fourth surface area has a length and a width that is greater than a length and a width of the second surface area; and joining the first magnetic core member with the second magnetic core member such that the first and second surfaces of the first magnetic core member join with the third and fourth surfaces of the second magnetic core member to form a magnetic flux path, wherein the oversized third and fourth surface areas are only sufficiently large to accommodate shifting and skew alignment during assembly of the first and second magnetic core members.

15. The method as defined in claim 14, wherein the first magnetic core further includes a middle surface formed between the first and second surfaces, and the second magnetic core member comprises a middle surface having an oversized area greater than the area of the middle surface of the first magnetic core member, wherein the middle surfaces are joined together to form a magnetic flux path.

16. The method as defined in claim 14, wherein the first magnetic core member comprises a generally E-shaped core member, and the second magnetic core member comprises a generally planar core member.

17. The method as defined in claim 14, further comprising the step of winding an electrical conductor around a magnetic flux path of the device.

18. The method as defined in claim 14, further comprising the step of adhering the first magnetic core member to the second magnetic core member.

19. A method of assembling a magnetic core device comprising:

providing a generally E-shaped magnetic core member having first, second, and third surfaces for providing magnetic flux, wherein said E-shaped magnetic core member has a length and a width;

providing a generally planar magnetic core member having a length and a width, wherein the length and width of the generally planar core member is greater than the length and width of the generally E-shaped core member; and joining the generally E-shaped magnetic core member with the generally planar magnetic core member so that the first, second, and third surfaces of the E-shaped core member form a magnetic flux circuit with the generally planar magnetic core member wherein the generally planar magnetic core member is oversized only sufficient to accommodate shifting and skew alignment during the joining of the generally E-shaped magnetic core member with the generally planar magnetic core member.

20. A magnetic core device for generating magnetic flux comprising:

a first magnetic core member having a generally open shape and first and second surfaces, said first and second surfaces having first and second surface areas, respectively; and a second magnetic core member having third and fourth surfaces for joining with the first and second surfaces, respectively, of the first magnetic core member to form a magnetic flux path, wherein the third and fourth surfaces have oversized third and fourth surface areas such that the third surface area has a length and a width that is greater than a length and a width of the first surface area and the fourth surface area has a length and a width that is greater than a length and a width of the second surface area, wherein the device is mounted on a circuit board.

21. The device as defined in claim 20, wherein the first magnetic core member further includes a middle surface formed between the first and second surfaces, and the second magnetic core member comprises a middle surface having an oversized area greater than the area of the middle surface of the first magnetic core member.

22. The device as defined in claim 21, wherein the first magnetic core member comprises a generally E-shaped core member, and the second magnetic core member comprises a generally planar core member.

23. The device as defined in claim 20, wherein the device is employed in an inductor.

24. The device as defined in claim 20, wherein the device is employed in a transformer.

25. The device as defined in claim 20, further comprising an electrical conductor wound around a magnetic flux path of the device.

26. The device as defined in claim 20, wherein the first magnetic core member is adhered to the second magnetic core member.

27. A method of assembling a magnetic core device for generating magnetic flux comprising:

providing a first magnetic core member having a generally open shape and first and second surfaces, wherein the first and second surfaces have first and second surface areas, respectively;

providing a second magnetic core member having third and fourth surfaces, wherein the third and fourth surfaces have oversized third and fourth surface areas such that the third surface area has a length and a width that is greater than the first surface area and the fourth surface area has a length and a width that is greater than a length and a width of the second surface area; and joining the first magnetic core member with the second magnetic core member such that the first and second surfaces of the first magnetic core member join with the third and fourth surfaces of the second magnetic core member to form a magnetic flux path, wherein the step of joining the first and second magnetic core members comprises arranging the first and second magnetic core members on a circuit board.

28. The method as defined in claim 27, wherein the first magnetic core further includes a middle surface formed between the first and second surfaces, and the second magnetic core member comprises a middle surface having an oversized area greater than the area of the middle surface of the first magnetic core member, wherein the middle surfaces are joined together to form a magnetic flux path.

29. The method as defined in claim 27, wherein the first magnetic core member comprises a generally E-shaped core member, and the second magnetic core member comprises a generally planar core member.

30. The method as defined in claim 27, further comprising the step of winding an electrical conductor around a magnetic flux path of the device.

31. The method as defined in claim 27, further comprising the step of adhering the first magnetic core member to the second magnetic core member.

* * * * *